US005221220A

United States Patent [19]

Roscizewski

[11] Patent Number: 5,221,220

[45] Date of Patent: Jun. 22, 1993

[54] STANDOFF BUSHING ASSEMBLY

[75] Inventor: Paul M. Roscizewski, Eagle, Wis.

[73] Assignee: Cooper Power Systems, Inc., Coraopolis, Pa.

[21] Appl. No.: 866,158

[22] Filed: Apr. 9, 1992

[51] Int. Cl.[5] ..... H01R 13/53

[52] U.S. Cl. ..... 439/843; 439/921

[58] Field of Search ..... 439/148, 135, 181, 183-187, 439/921, 843; 174/37, 73.1

[56] References Cited

U.S. PATENT DOCUMENTS

| | | | |
|---|---|---|---|
| 3,388,299 | 6/1968 | Brideweser | 174/37 |
| 3,930,709 | 1/1976 | Stanger et al. | 339/111 |
| 3,957,332 | 5/1976 | Lambert, III | 339/12 R |
| 4,082,411 | 4/1978 | Storck | 439/843 |
| 4,170.394 | 10/1979 | Conway | 339/111 |
| 4,186,985 | 2/1980 | Stepniak et al. | 339/111 |
| 4,773,872 | 9/1988 | Borgstrom et al. | 439/185 |
| 4,863,392 | 9/1989 | Borgstrom et al. | 439/185 |
| 4,955,823 | 9/1990 | Luzzi | 439/921 |

*Primary Examiner*—Neil Abrams
*Attorney, Agent, or Firm*—David A. Rose

[57] ABSTRACT

The insulated standoff bushing is used for terminating a connector probe connected to a high voltage circuit. The standoff bushing includes an insulated body having a bore for receiving a shielded housing. The shielded housing in turn has an aperture for receiving a contact which is secured within the aperture. The contact is in the form of a spring having opposed sides with contact pads. The connector probe is inserted into the aperture of the shield housing and passes between the opposed contact pads for the dissipation of current into the insulated standoff bushing.

14 Claims, 3 Drawing Sheets

STANDOFF BUSHING ASSEMBLY

BACKGROUND OF THE INVENTION

The present invention relates to electrical standoff bushings and more particularly to a contact for a standoff bushing assembly.

High-voltage separable connectors interconnect sources of energy such as transformers to distribution networks or the like. A typical arrangement includes a standoff or bushing well connected to the transformer and an elbow connector connected to a distribution line. The bushing well includes a bushing insert, which contains a female contact, connected to the well and the elbow connector includes a male contact which electrically joins the female contact of the bushing insert.

Frequently, it is necessary to connect and disconnect the electrical connectors of the power distribution systems. The "loadmake" of the electrical connectors includes the joinder of the male and female contacts, one energized and the other engaged with a normal load. In the "loadbreak" of the connectors, the male and female contacts are separated while they supply power to a normal load. A "fault closure" situation can occur which involves the joinder of the male and female contacts, one energized and the other engaged with a load having a fault, as for example, a short circuit condition.

One type of separable connector assembly is the "rod and bore" switching type. In this assembly, the bushing well or switch module includes a receiving bore tube, or snuffer, which is situated within a passageway in a shielded, insulating housing. The passageway includes a female contact at the interior end of the bore tube. The elbow connector or matching rod connector module includes a rod contact which is inserted in the bore tube for electrical engagement with the bore female contact.

To fully appreciate the problems encountered with the loadbreak or disconnection of the connector assemblies, it is helpful to review the industrial practices common to separable electrical connector assembly usage. More particularly, in disengaging or disconnecting the electrical contact between the rod and bore contacts, or "loadbreak" condition, an operator manually moves the rod connector module with its rod contact away from engagement with the bore female contact of the switch module through the use of a conventional "hot stick" or other suitable insulating means. Upon disconnecting the rod contact, the rod connector module is still live and energized. Thus, it is necessary to safely terminate or park the rod connector module after the loadbreak or disconnection by inserting the rod connector module into a standoff bushing assembly mounted on the transformer or other enclosure.

The 200 amp standoff bushing assembly of the prior art isolates the energized rod connector module when the rod connector module is not in use. To make the standoff bushing assembly perform to standard electrical requirements, the electrical contact in the standoff bushing assembly must be made from the rod contact in the rod connector module to a conductive voltage stress relieving housing within the standoff bushing assembly. This electrical contact between the rod contact and standoff housing is made through a contact which is threaded into the housing of the contact. This threaded contact is designed to carry 200 amps, although the capability of carrying 200 amps is not needed.

Further, the jacket around the prior art standoff body is painted on and becomes scuffed during use.

The present invention overcomes the deficiencies of the prior art.

SUMMARY OF THE INVENTION

The standoff bushing assembly of the present invention includes a contact which electrically engages the conductive standoff housing through a formed spring contact. The spring contact contains contact pads which make contact with the probe of the elbow. When the elbow probe is inserted through the spring contact pads, the contact spring expands within the cylindrical standoff housing making contact from the probe through the contact to the standoff housing.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
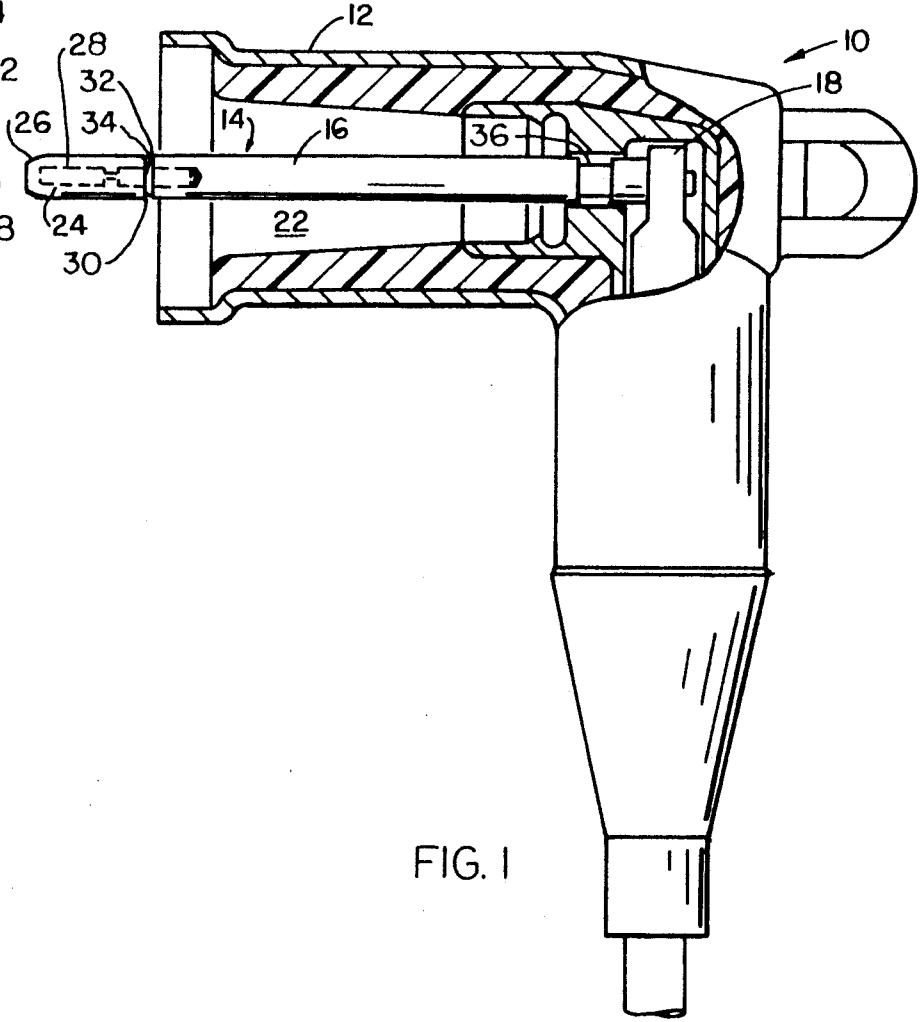
FIG. 1 is a cross-sectional view of the elbow probe connector of the present invention.
Figure 2:
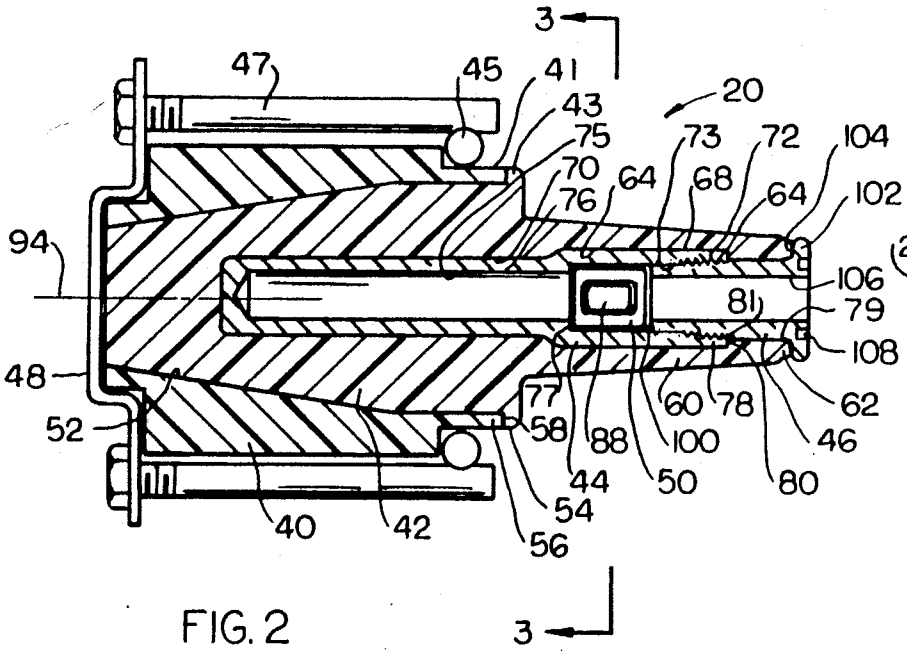
FIG. 2 is a cross-sectional view of the standoff bushing assembly of the present invention.

Referring initially to FIG. 1, there is shown an elbow connector 10 to be terminated and parked in an insulated standoff bushing assembly 20 shown in FIG. 2. The elbow connector 10 includes an elastomeric housing 12 of a material such as EPDM (ethylene-propylene-dienemonomer) rubber which is provided on its outside surface with a conductive shield layer which is grounded (not shown). A probe 14 extends from a conductor contact 18 within the housing 12 into a cup-shaped recess 22 of housing 12. Probe 14 includes a metal rod 16 of a material such as copper and at the opposite end of probe 14, an arc follower 24 of ablative material. The unattached end of the arc follower 24 is tapered at 26. A preferred ablative material for the arc follower 24 is acetal copolymer resin loaded with finely divided melamine. The ablative material is typically injection molded onto an epoxy bonded glass fiber reinforcing pin 28, best shown in FIG. 4, which is inserted into a bore 29 in the end of metal rod 16. Reinforcing pin 28 may be metallic for a 25 kV class service of the standoff bushing assembly 20.

The probe 14 includes an annular recess 30 between the ends of arc follower 24 and metal rod 16. The junction recess 30 includes a tapered end wall 32 adjacent the arc follower 24 and an untapered end wall 34 on the terminal end of arc follower 24 adjacent contact rod 16. In addition, the probe 14 includes a stress relief recess 36 at a portion thereof which is located a predetermined distance from the junction recess 30.

Referring now to FIG. 2, standoff bushing assembly 20 includes an outer, semi-conductive, cylindrical jacket 40, a medial body member 42, a shield housing 44, a nose piece 46 and a contact 50. As shown, standoff bushing assembly 20 is mounted on a bracket 48 which in turn is disposed on an enclosure for electrical distribution equipment such as a transformer. The outer, semi-conductive cylindrical jacket 40 is made of a semi-conductive EPDM rubber. Outer jacket 40 includes a bore 52 having a profile adapted to receive the outer surface of medial member 42. Bore 52 has a generally cylindrical opening with a tapering interior shape. Jacket 40 includes an outer reduced diameter portion 41 forming an annular shoulder 43. An annular metal ring 45 affixed to the ends of a plurality of bolts 47 slides over reduced diameter portion 41 against annular shoulder 43. The opposite threaded ends of bolts 47 are bolted to bracket 48. The jacket 40 and medial member 42 form the standoff body. The semi-conductive jacket 40 is molded on member 42 to form a scuff-proof external shield.

Medial body member 42 is made of EPDM rubber and includes an outwardly extending annular flange 54 which forms an annular shoulder 56 for mating engagement with the terminal end 58 of outer jacket 40. Medial member 42 further includes an outwardly projecting barrel 60 tapering towards its outer terminal end 62.

Medial member 42 includes a bore 64 axially extending through barrel 60 and into the main body of medial member 42. Bore 64 includes a neck portion 66 at its open end with a major diameter portion 68 formed within barrel portion 60 and an inner blind bore portion 70 having a reduced diameter.

Shield housing 44 is made of impacted aluminum and includes an enlarged cylindrical portion 72 having an enlarged bore 73 with threads 74 at its open end 78 and a closed end reduced diameter portion 76 with a reduced diameter bore 75. The closed end diameter portion 76 is received within reduced diameter portion 70 of bore 64 and cylindrical portion 72 is received within major diameter portion 68 of barrel 60. The terminal open end 78 of shield housing 44 abuts against a shoulder 80 formed between neck 66 and major diameter portion 68. An annular shoulder 77 is formed by the diameter change between enlarged and reduced diameter portions 72 and 76. Shield housing 44 is for stress relief only and is not a current carrying component.

Figure 3:
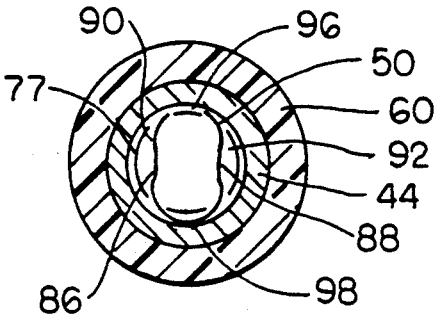
FIG. 3 is a cross-sectional view of the contact of the standoff bushing assembly of the present invention shown at plane 3—3 in FIG. 2.
Figure 6:
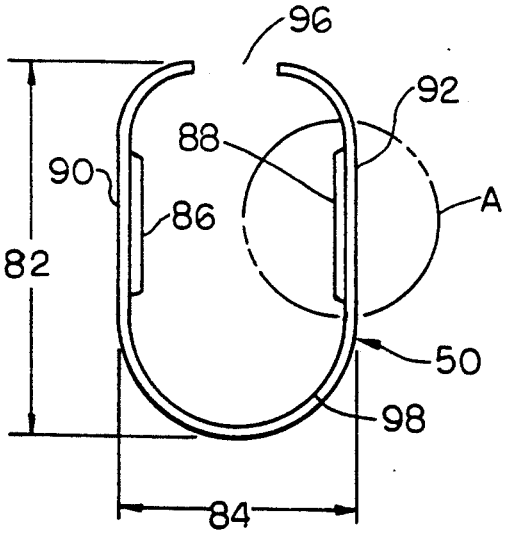
FIG. 6 is an end view of the contact spring.
Figure 7:
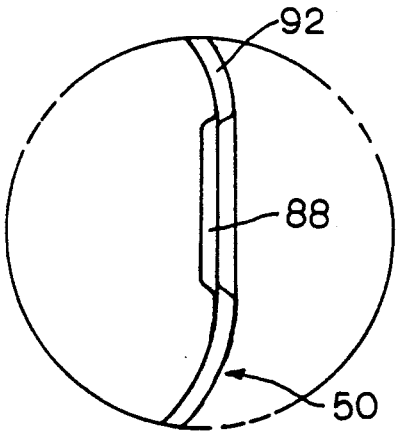
FIG. 7 is a enlarged view of detail A of FIG. 6 showing the contact pad.

Referring now to FIGS. 2, 6 and 7, the contact 50 is a generally C-shaped spring having a major dimension 82 and a minor dimension 84 so as to also form a generally oval shape in cross-section. Contact 50 is made of a tin-plated beryllium copper forming a spring with opposite sides 90, 92. Opposing contact pads 86, 88 are stamped into the major dimensioned sides 90, 92 of contact 50, respectively. Contact pads 86, 88 are generally rectangular and have their major dimension extending parallel to the axis 94 of shield housing 44. As shown in FIG. 3, the open end 96 of contact spring 50 is in the contracted position prior to the insertion of probe 14. The closed end 98 on a minor dimension side bias the two opposed sides 90, 92 and thus pads 86, 88 towards each other which contacting the interior wall of bore 64. The major dimension 82 of contact spring 50 is sized to be smaller than the diameter of enlarged bore 73 so to allow contact spring 50 to be slidingly received within bore 73. However, the major dimension 82 is greater than the diameter of bore 75 such that one end of contact 50 bears against annular shoulder 77.

Referring now to FIG. 2, a generally cylindrical nose piece 46 is received within the open end 78 and bore 73 of shield housing 44 and is threadingly engaged therewith by means of threads 74. The inner terminal end 100 of nose piece 46 forms an inner annular shoulder opposite shoulder 77 to secure contact 50 within bore 73 of shield housing 44. Nose piece 46 includes an enlarged diameter portion 79 forming an inwardly facing annular shoulder 81. Upon engagement of threads 74, shoulder 81 bottoms on the terminal end 78 of shield housing 44. Nose piece 46 also includes an external annular flange 102 which forms a shoulder 104 which faces the terminal end 62 of barrel 60. Nose piece 46 includes a bore 106 therethrough having substantially the same diameter as bore 75 and is in alignment therewith. A plurality of apertures 108 are provided in the outer circumferential surface of annular flange 102 for engagement with the cleats of a tool (not shown) for threadingly engaging nose piece 46 with shield housing 44 at threads 74 after contact 50 has been received by bore 73.

Figure 5:
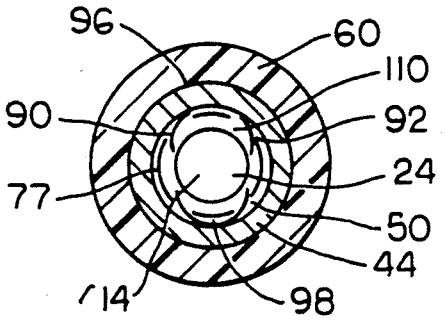
FIG. 5 is a cross-sectional view shown at plane 5—5 in FIG. 2 showing the probe within the contact of the standoff bushing assembly.
Figure 4:
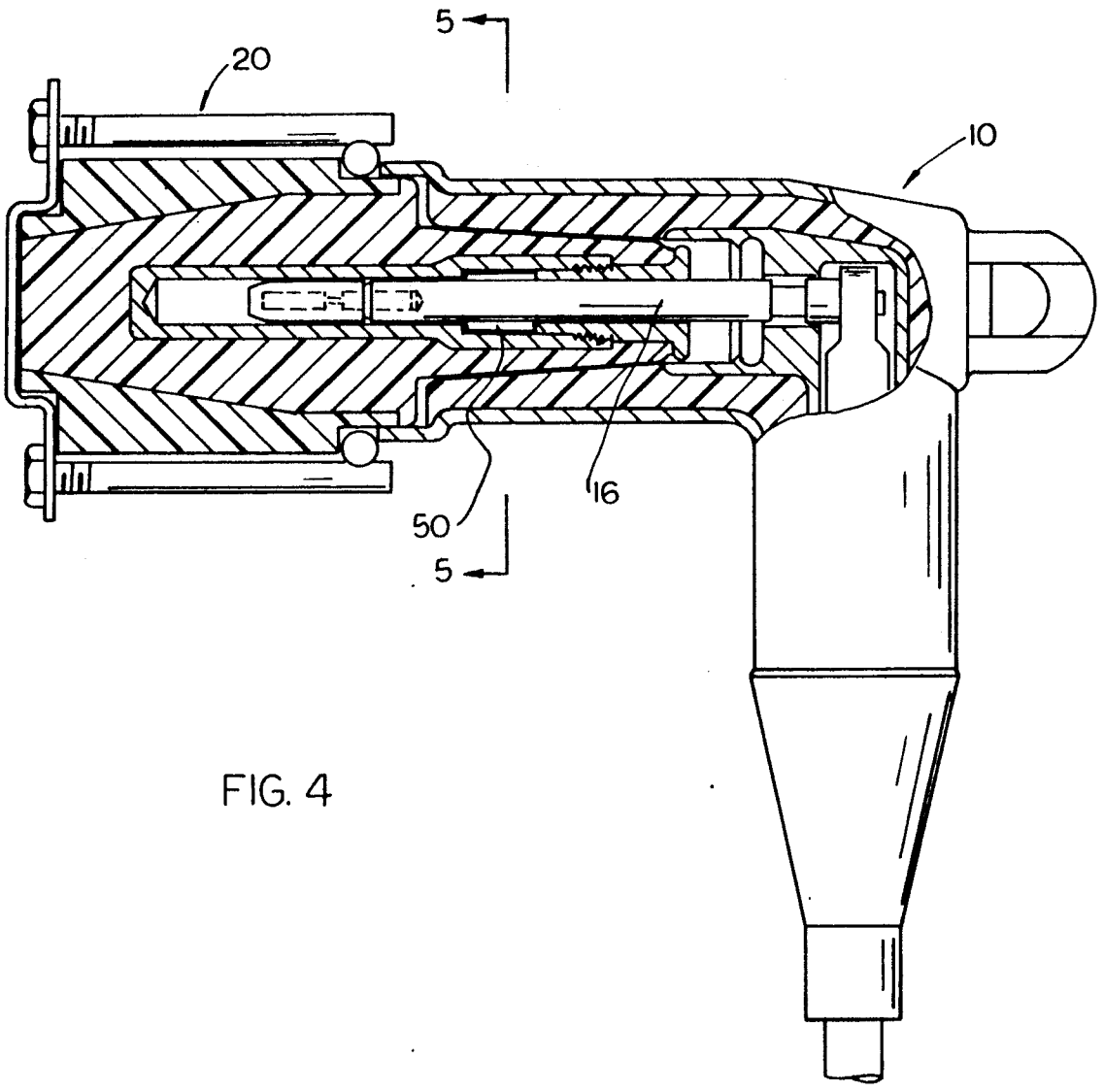
FIG. 4 is a cross-sectional view of the assembled standoff bushing assembly and probe connector of FIG. 1.

Referring now to FIG. 4, probe 14 is shown assembled within shield housing 44. The arc-ablative end 24 of probe 14 is received within the bore 106 of nose piece 46 and is also received within the aperture 110 formed between the sides of contact 50. As shown in FIG. 5, the probe 14 expands the major dimension sides 90, 92 of contact 50 with the open end 96 of contact spring 50 in its expanded position. The copper contact 50 has proven a reliable, positive contact with the mating elbow probe 14.

In operation, the contact 50 makes contact with the insulated standoff bushing assembly 20 through formed contact 50 The contact pads 86, 88 of contact 50 make contact with the probe 14 of the elbow connector 10. When the elbow probe 14 is inserted through the passageway between the contact pads 86, 88 using a hot-stick tool, the contact 50 expands within the cylindrical standoff shield housing 44 making contact from the probe 14 through the contact spring 50 to the standoff shield housing 44. Once inserted into the insulated standoff bushing assembly 20, there is a dissipation of current through the insulation of the standoff bushing assembly 20. No current is carried by the shield housing 44. There is some leakage of current in the range of milli- or micro- amps through the assembly 20. The ground shell will have some potential so that there will be some type of current passing through the insulated standoff bushing assembly 20.

The insulated standoff bushing assembly 20 of the present invention is designed for 200 amp 15 kV or 25 kV class service. However, the present invention may be used for other classes of service. The 200 amp standoff bushing assembly 20 of the present invention is used to isolate the energized elbow terminator or probe 14 when the elbow connector 10 is not in use. To cause the standoff bushing assembly 20 to perform to standard electrical requirements, electrical contact must be made from the probe 14 in the elbow connector 10 to the conductive voltage stress relieving body member 42 within the standoff bushing assembly 20. The standoff bushing assembly 20 has shown to be of a more economical design because the new body is easier to mold and the contact spring 50 is easier to assemble. Further, the standoff bushing assembly 20 of the present invention is fully shielded and fully submersible.

While a preferred embodiment of the invention has been shown and described, modifications thereof can be made by one skilled in the art without departing from the spirit of the invention.

What is claimed is:

1. A standoff for terminating and parking a connector probe, comprising:

an insulated housing having a bore;

a shield member disposed within said bore and having an aperture adapted to receive the connector probe;

a contact slidingly disposed within said aperture, said contacting having minor dimensioned side and opposed major dimensioned sides;

said contact having a passageway with a contracted position where said opposed major dimensioned sides are contracted and an expanded position where said opposed major dimensioned sides are expanded; and said passageway adapted to receive the connector probe whereby said opposed major dimensioned sides are expanded from said contracted to said expanded position.

2. The standoff of claim 1 wherein said contact includes opposed contact pads on said opposed major dimensioned sides for engagement with the connector probe.

3. The standoff of claim 1 wherein said contact is a spring.

4. The standoff of claim 3 wherein said spring is generally oval-shaped, said minor dimensioned side forming a closed end between said opposed major dimensioned sides.

5. The standoff of claim 4 wherein each of said opposed major dimensioned sides includes a contact pad adapted for engagement with the connector probe.

6. The standoff of claim 1 further including means for securing said contact against said shield member within said aperture.

7. The standoff of claim 2 wherein said contact pads are stamped into said opposed major dimensioned sides.

8. The standoff of claim 2 wherein said opposed contact pads are rectangular in shape and have a major dimension which is parallel to the connector probe in said expanded position.

9. The standoff of claim 1 wherein said aperture is cylindrical with a diameter and said opposed major dimensioned sides have a length less than said diameter.

10. The standoff of claim 6 wherein said securing means includes a member disposed within said aperture.

11. An insulated standoff bushing for terminating a connector probe, comprising:

a body having an axial first bore with a first enlarged diameter portion;

a shield housing having a second enlarged diameter portion and an axial second bore with a third enlarged diameter portion; said first bore receiving said shield housing with said second enlarged diameter portion of said housing being disposed within said first enlarged diameter portion of said first bore; said third enlarged diameter portion forming an annular shoulder;

a contact in the form of a generally C-shaped spring having an opening therethrough between opposed sides and disposed within said third enlarged diameter portion adjacent said annular shoulder such that said opening is coaxial with said second bore;

a nose piece with a third bore and threadingly engaged with said shield housing and having a terminal end adjacent said contact to secure said contact between said annular shoulder and nose piece.

12. The bushing of claim 11 wherein said sides of said contact have contact pads for engaging the connector probe.

13. The bushing of claim 11 wherein said body further includes a semi-conductor outer jacket molded thereto.

14. An electrical terminator for terminating an electrical circuit, comprising;

a connector having a probe connected to a high voltage circuit;

a standoff bushing having an insulated housing with a central bore;

a shield member disposed within said bore and having an aperture;

a spring having opposed sides with a closed end;

opposed contact pads mounted on said opposed sides for biasing said opposed contact pads toward each other in a contracted position, aid opposed contact pads disposed in said aperture;

said probe being received within said aperture and disposed between said opposed contact pads making electrical contact therewith;

said standoff bushing having means for stabilizing and maintaining said probe within said aperture of said standoff bushing to terminate the high voltage circuit.

* * * * *